US008533905B1

(12) United States Patent
Tran

(10) Patent No.: US 8,533,905 B1
(45) Date of Patent: Sep. 17, 2013

(54) VACUUM ACCESSORY TOOL

(75) Inventor: Phong H. Tran, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 388 days.

(21) Appl. No.: 12/946,369

(22) Filed: Nov. 15, 2010

(51) Int. Cl.
*A47L 5/10* (2006.01)
*A47L 5/26* (2006.01)

(52) U.S. Cl.
USPC ..... 15/389; 15/387

(58) Field of Classification Search
USPC ..... 15/389, 387, 365, 367, 375, 416, 15/421, 383, 384, 391, 394, 401, 179, 182
See application file for complete search history.

(56) References Cited

U.S. PATENT DOCUMENTS

| | | | | |
|---|---|---|---|---|
| 3,574,885 | A | 4/1971 | Jones | |
| 4,042,995 | A | 8/1977 | Varon | |
| 5,148,569 | A | 9/1992 | Jailor et al. | |
| 6,711,777 | B2 | 3/2004 | Frederick et al. | |
| 7,185,396 | B2 * | 3/2007 | Im et al. | 15/366 |
| 2002/0170140 | A1 | 11/2002 | Diaz et al. | |
| 2006/0162121 | A1 * | 7/2006 | Naito et al. | 15/416 |
| 2006/0248680 | A1 | 11/2006 | Heidenga et al. | |
| 2011/0047744 | A1 * | 3/2011 | Bozzelli et al. | 15/339 |

FOREIGN PATENT DOCUMENTS

| | | |
|---|---|---|
| DE | 2100465 | 7/1972 |

* cited by examiner

*Primary Examiner* — Dung Van Nguyen
(74) *Attorney, Agent, or Firm* — McGarry Bair PC

(57) ABSTRACT

A vacuum accessory tool comprises a housing that defines a suction nozzle and an agitator assembly located in the suction nozzle and driven by an air turbine. The agitator assembly comprises an agitating element having a plurality of resilient blades configured to reduce hair wrap around the agitator assembly.

16 Claims, 8 Drawing Sheets

VACUUM ACCESSORY TOOL

BACKGROUND OF THE INVENTION

Household pets, such as dogs and cats, tend to shed hair, which collects on carpets, furniture, and other areas of the home. A common complaint of pet owners is the seemingly never-ending battle to remove the pet hair. Pet hair and other similar debris can be relatively small and difficult to collect, even with conventional vacuum cleaners. Further, when vacuum cleaners having rotating or otherwise moving parts, such as rotatable agitators and air turbines, in the suction path are used to remove pet hair and other similar debris, the pet hair can collect at the moving parts, thereby impeding the operation and effectiveness of the vacuum cleaner.

U.S. Pat. No. 6,711,777 to Frederick et al. discloses a turbine powered vacuum cleaner tool wherein a nozzle body encloses an agitator located adjacent an elongated suction inlet opening. A turbine rotor is rotatably connected to the nozzle body and operatively connected to the agitator so that airflow generated by a remote suction source flows through the nozzle body and rotates the agitator.

U.S. Pat. No. 4,042,995 to Varon discloses a brush for removing animal hair from carpeting and upholstery comprising a plurality of flexible bristles composed of polymeric materials that create an electrostatic charge to attract the animal hair to the bristles.

U.S. Pat. No. 3,574,885 to Jones discloses a brush having a base member, a plurality of flexible plastic bristles mounted to the base member and a tubular adapter for connection with a vacuum cleaner to remove loose hair dislodged while brushing an animal. In an alternate embodiment, the brush comprises a mitt secured to a flexible base member to receive the hand of the operator.

German Patent Application Publication No. 2,100,465 to Schwab discloses a sweeper with a horizontal brush driven by the rotation of ground engaging wheels. Bristle pads are arranged on both sides of the brush and have bristles directed toward the rotating horizontal brush.

U.S. Patent Application Publication No. 2002/0170140 to Diaz et al, now abandoned, discloses a vacuum cleaner adapter comprising a bristle wheel comprising protruding bristles for removing hair and animal fur from rugs and carpets. The bristles can be made of natural or synthetic organic, polymeric, elastomeric, or composite materials such as nylon, rubber, or the like.

U.S. Pat. No. 5,148,569 to Jailor discloses a debris impeller for a cleaning device comprising impeller segments with a non-cylindrical opening configured to be slipped over a twisted flat wire axle. Each impeller segment comprises a plurality of resilient paddles that extend radially outwardly from a central hub section.

U.S. Patent Application Publication No. 2006/0248680 to Heidenga et al. discloses a vacuum accessory tool having a rotating agitator brush with bristles and a separate hair removal element.

SUMMARY OF THE INVENTION

According to one aspect of the invention, a vacuum accessory tool comprises a nozzle body, a suction nozzle formed by the nozzle body, a suction conduit formed in the nozzle body and adapted to be connected to a suction source remote from the nozzle body for generating a working air flow from the suction nozzle through the nozzle body, and an agitator assembly mounted to the nozzle body and positioned adjacent the suction nozzle. The agitator assembly comprises a dowel mounted within the nozzle body for rotational movement about an axis and an agitating element provided on the dowel and comprising a plurality of resilient blades extending generally axially along and projecting outwardly from the dowel, wherein at least two of the resilient blades have a gap therein extending from a distal end of the blade toward the dowel, and wherein the gap in one of the at least two resilient blades is axially offset from the gap in another of the at least two resilient blades.

DETAILED DESCRIPTION

The invention generally relates to vacuum cleaning accessory tools. In one aspect, the invention relates to an accessory tool adapted to remove pet hair from carpet and other fabric surfaces. In another aspect, the invention relates to an accessory tool having an improved agitator assembly comprising an agitating element having a plurality of resilient blades that enhance hair removal and to prevent hair wrapping around the agitator dowel. For purposes of description related to the figures, the terms "upper," "lower," "right," "left," "rear," "front," "vertical," "horizontal," and derivatives thereof shall relate to the accessory tool as oriented in FIG. 1 from the perspective of a user behind the accessory tool, which defines the rear of the accessory tool. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
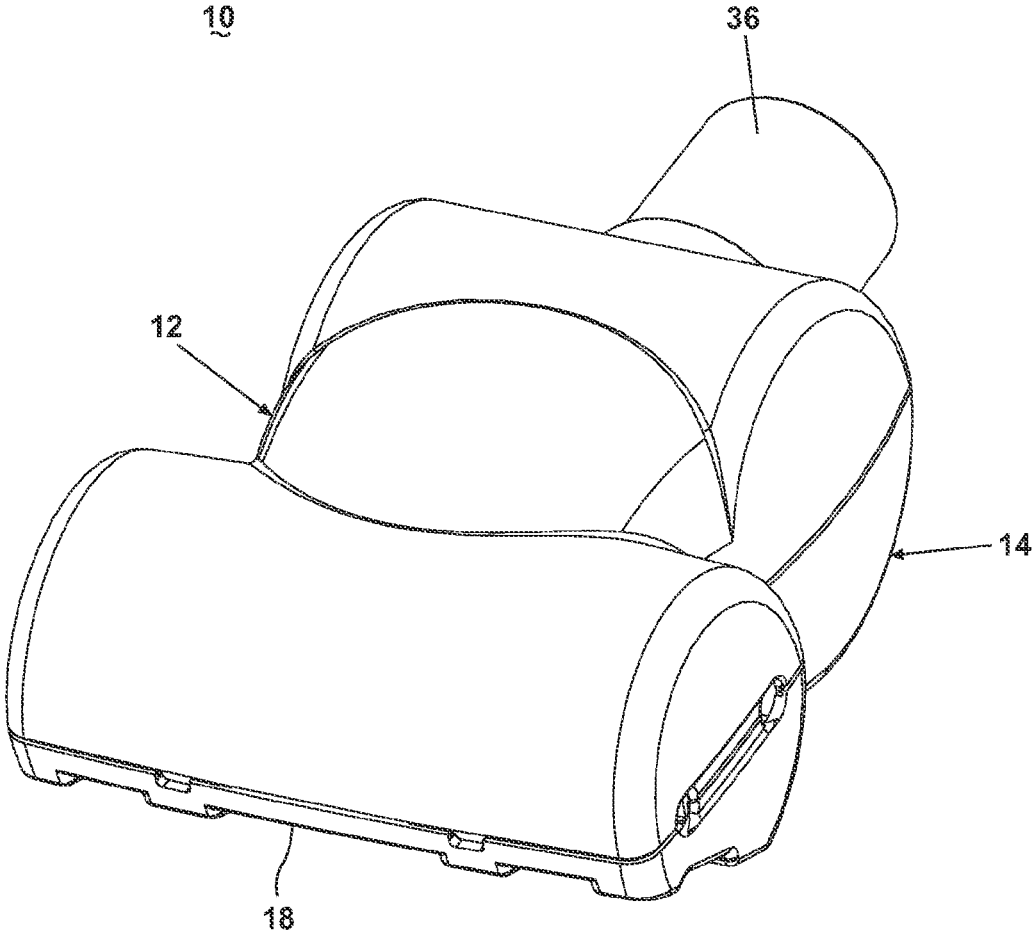
FIG. 1 is a front perspective view of a vacuum accessory tool with a hair removal assembly and an impeller assembly according to one embodiment of the invention.
Figure 2:
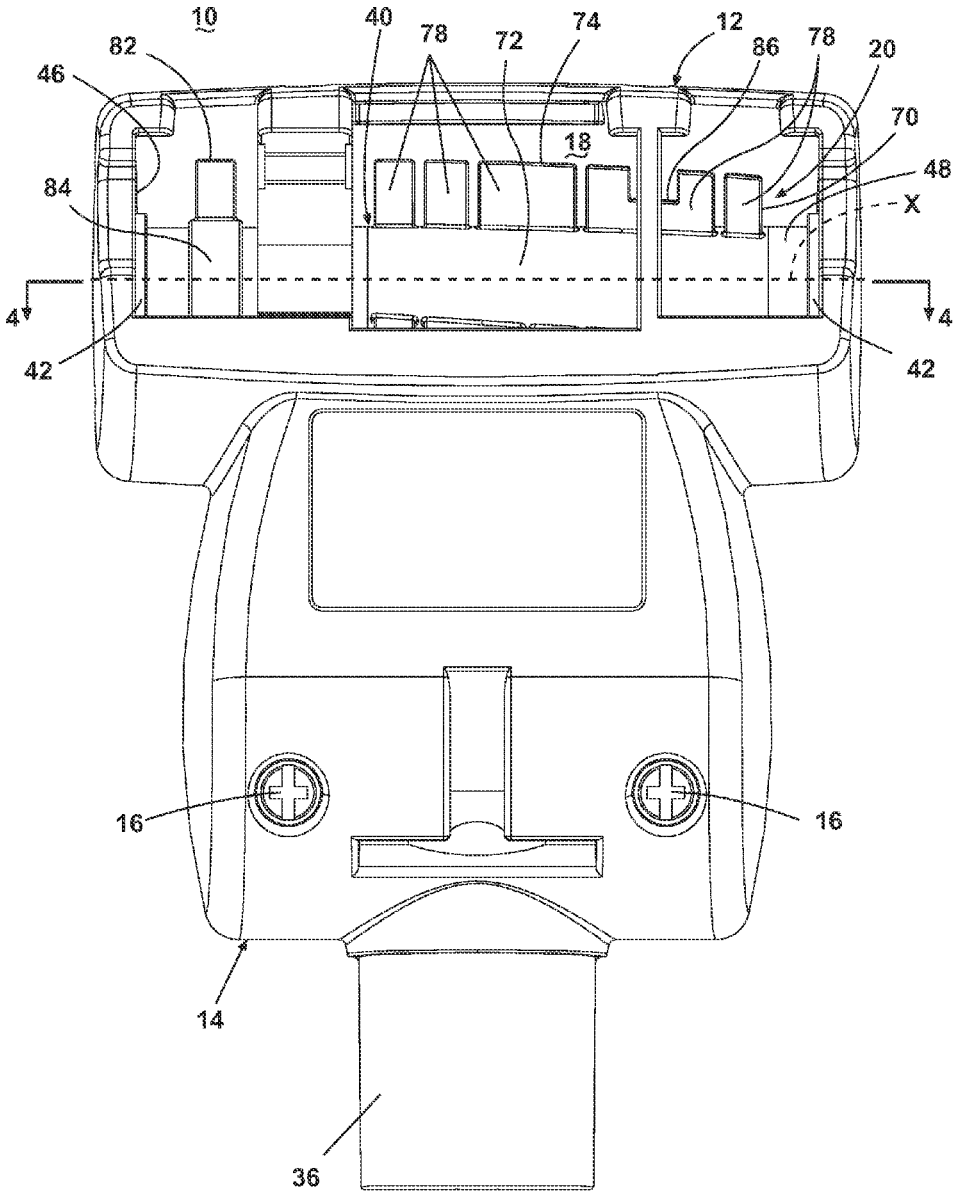
FIG. 2 is a bottom view of the vacuum accessory tool shown in FIG. 1.
Figure 3:
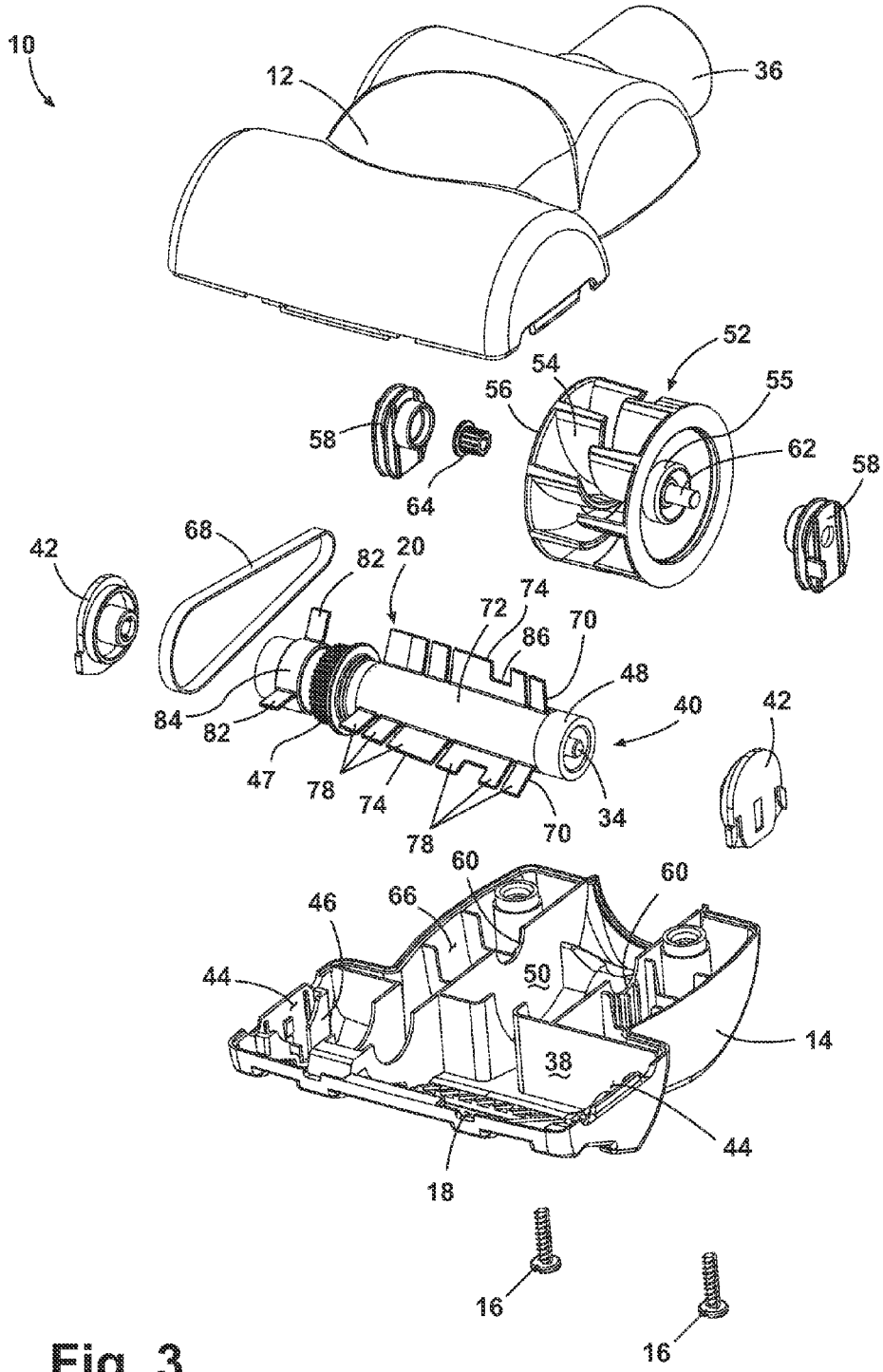
FIG. 3 is an exploded view of the vacuum accessory tool shown in FIG. 1.

Referring to the drawings, FIGS. 1-3 show a vacuum accessory tool 10 having a nozzle body formed by an upper housing 12 and a lower housing 14. The upper and lower housings 12, 14 can be secured together with mechanical fasteners 16. Alternatively, the upper and lower housings 12, 14 can be secured together via a removable retaining ring as described in U.S. Patent Application Publication No. 2006/0248680 to Heidenga et al., which is incorporated herein by reference in its entirety, or by other conventional fastening means such as adhesive, ultrasonic welding, or the like. A suction nozzle 18 is formed at a forward, lower portion of the lower housing 14.

The upper housing 12 further comprises a working air conduit 36 positioned on an end of the nozzle body 10 opposite the suction nozzle 18. The working air conduit 36 fluidly communicates the suction nozzle 18 with a remote suction source, as is commonly found in an upright or canister vacuum cleaner. The working air conduit 36 is typically connected to the upright or canister vacuum cleaner via a flexible hose. A lower agitator chamber 38 is formed in a forward portion of the lower housing 14 in close proximity to and in fluid communication with the suction nozzle 18.

An agitator assembly 40 having a dowel 48 that supports an agitating element 20 is rotatably mounted within the agitator chamber 38 via bearing assemblies 42, which are located on the ends of the dowel 48. Slotted ribs 46 are offset from the inner sidewalls of the agitator chamber 38 and form opposed brush bearing supports 44 that are sized to receive agitator bearing assemblies 42. The cylindrical dowel 48 includes bearing pins 34 fixed at both ends thereof. The bearing pins 34 are rotatably received within the bearing assemblies 42, thus permitting the dowel 48 to rotate about an axis X with respect to the agitator chamber 38. The agitator assembly 40 further comprises an agitator pulley 47 formed on the dowel 48 near of end of the dowel 48.

Figure 5:
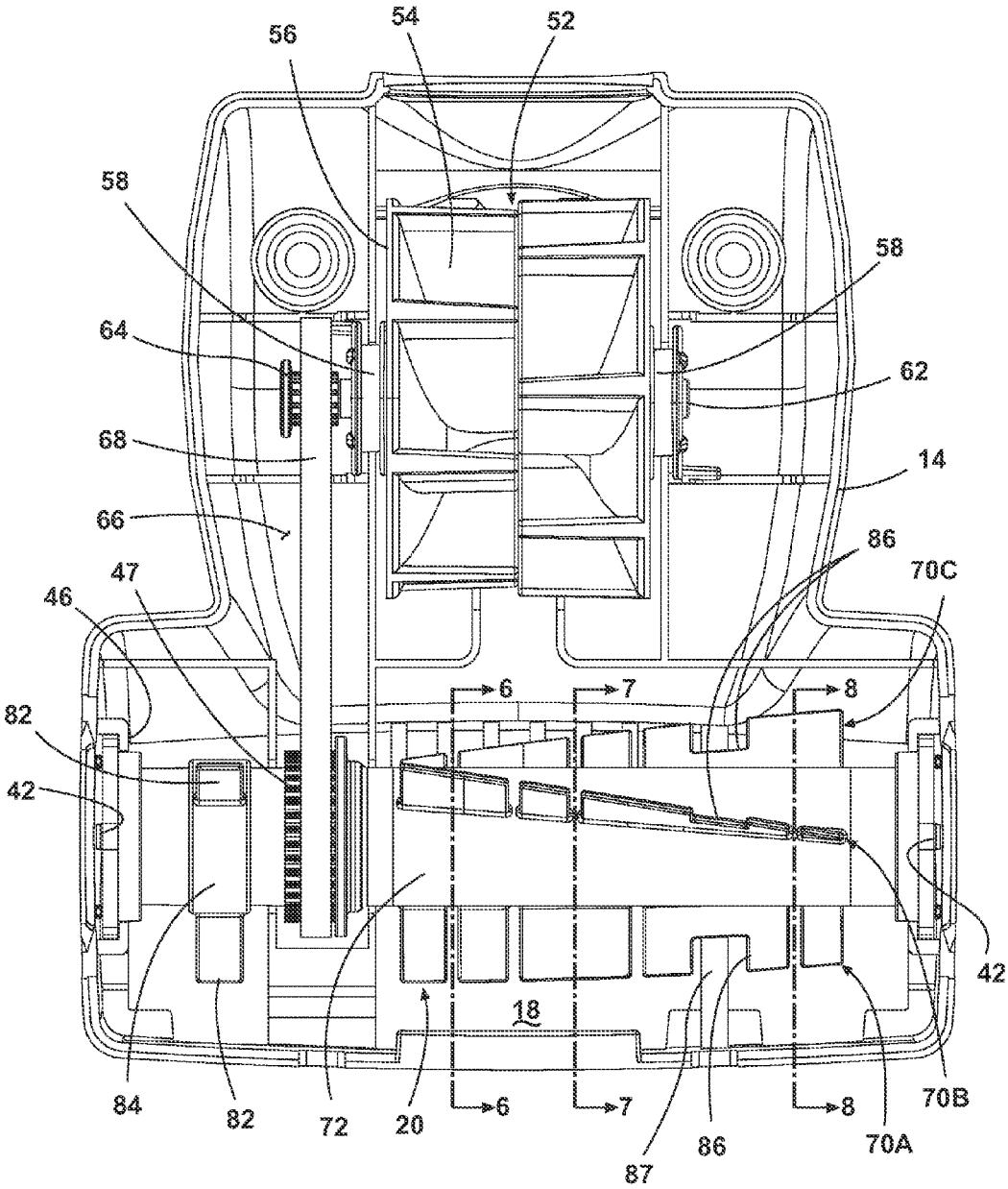
FIG. 5 is a top view of the vacuum accessory tool of FIG. 1, with the top housing removed for clarity.

Referring now to FIG. 3, an impeller chamber 50 is formed between the suction nozzle 18 and the working air conduit 36 and receives an air-driven impeller assembly 52. In the illustrated embodiment, the impeller assembly 52, which is shown in FIGS. 3 and 5, comprises a plurality of arcuate blades 54 that extend radially outwardly from a central hub 55 between two end walls 56. The sets of the blades 54 are offset from one another so that a blade 54 of one of the sets is positioned between adjacent blades 54 of the other set, as best viewed in FIG. 5. Alternatively, the sets of blades can be aligned with each other.

The impeller assembly 52 is mounted on an axle 62 that passes through the hub 55 and defines an axis about which the impeller assembly 52 rotates. The axle 62 is received within opposed bearing assemblies 58 that are mounted to bearing supports 60 formed within the impeller chamber 50 and protruding from the upper and lower housings 12, 14. A belt pulley 64 is fixed to one end of the axle 62 and is adapted for cooperative rotation therewith. A drive belt 68 operably connects the belt pulley 64 to the agitator pulley 47. In operation, when the blades 54 are exposed to a moving air stream, such as that created by the remote suction source, the axle 62 rotates with the blades 54, and the belt pulley 64 rotates with the axle 62. Additional details of a suitable impeller assembly 52 for use with the vacuum accessory tool 10 can be found in Heidenga, referenced above.

Referring now to FIG. 3, the lower housing 14 further comprises a belt compartment 66 formed adjacent the impeller chamber 50 and extending into the agitator chamber 38. The belt compartment 66 is sized to receive a drive belt 68, which mechanically couples the belt pulley 64 on the impeller assembly 52 to the agitator pulley 47 on the agitator assembly 40. The belt 68 is maintained under tension between the belt pulley 64 and the agitator pulley 47 so that rotation of the belt pulley 64 induces rotation of the belt 68 and, thereby, the agitator pulley 47 to rotate the agitator assembly 40, as is well-known in the vacuum cleaner art. The upper housing 12 forms a cover to mate with the lower housing 14 and enclose the agitator assembly 40, the impeller assembly 52, and the belt 68 while also forming an upper surface of a working air path from the suction nozzle 18, through the agitator chamber 38, and through the impeller chamber 50 to the working air conduit 36.

Alternatively, instead of being coupled to an impeller assembly 52 that is driven by a remote suction source, the agitator assembly 40 can be operably interconnected with a motor (not shown) provided within the nozzle body 10. The motor can be coupled with the drive belt 68 for imparting rotational movement to the agitator assembly 40.

Figure 4:
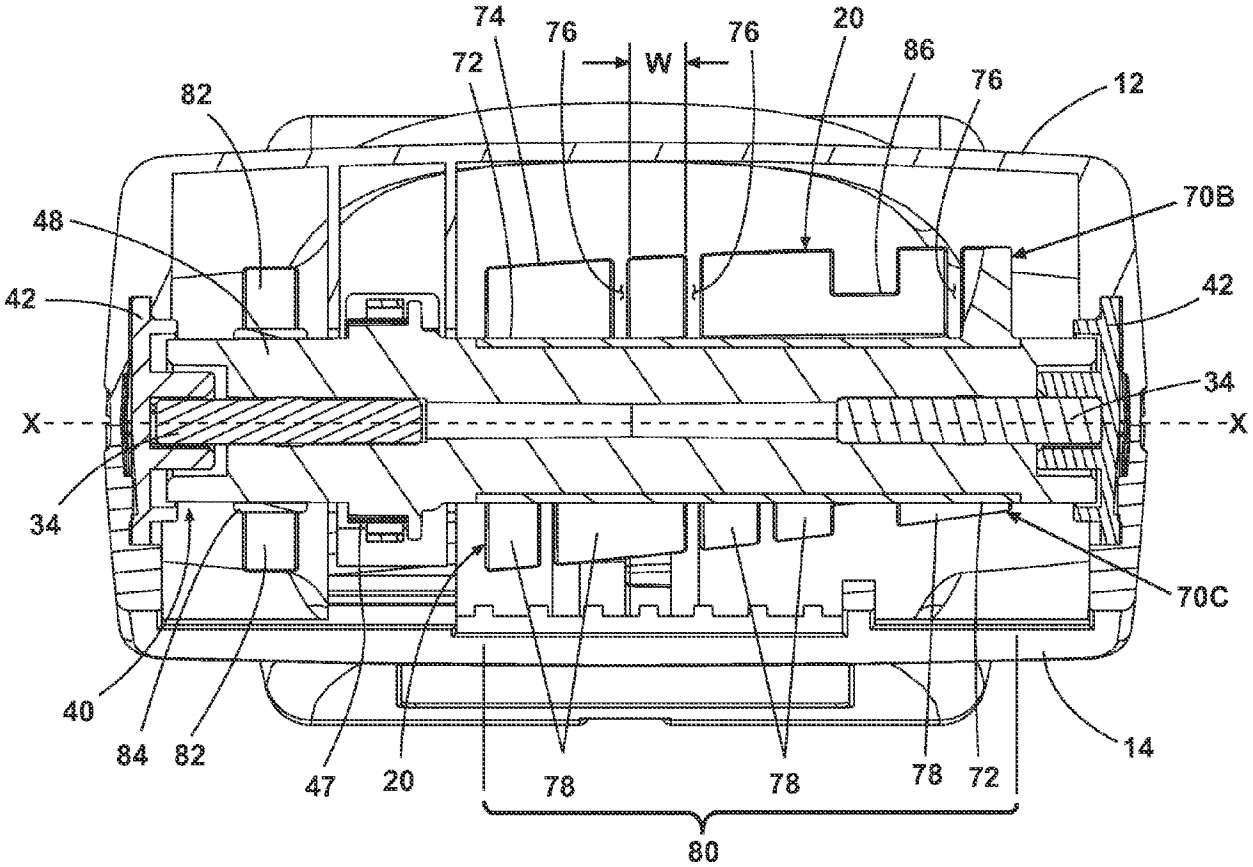
FIG. 4 is a sectional view taken along line 4-4 of FIG. 2.

FIG. 4 is a cross-sectional view taken along line 4-4 of FIG. 2. The agitating element 20 comprises primary portion having a plurality of resilient blades 70 extending generally axially along and projecting outwardly from the dowel 48. The blades 70 include a proximal end attached to a base 72 that wraps around the dowel and a free distal end 74. As illustrated, three radially spaced blades 70 are provided on the dowel 48, each of which share a common base 72. The three successive blades 70 are optionally referred to as "70A", "70B" and "70C" for purposes of discussion. Alternatively, additional blades 70 can be incorporated onto the dowel 48 or one of the three blades 70 can be removed. The blades 70 can extend along and wrap around the dowel 48 in a non-parallel orientation with respect to the axis X of the dowel 48; in the illustrated embodiment, the blades 70 are helical. The blades 70 can be secured to the dowel 48 by various manufacturing techniques, such as overmolding, insert molding, application of an adhesive or mechanical engagement. As illustrated, the blades 70 are secured to the dowel 48 using insert molding; as such, the blades 70 are formed from one continuous piece of material connected by the base 72, which is made of the same material as the blades 70. Alternatively, each blade 70 can be provided with a separate base 72 and individually attached to the dowel 48.

The blades 70 can be molded from a flexible thermoplastic elastomer material, such as, but not limited to, a mixture of EPDM (ethylene propylene diene monomer) rubber and polypropylene (i.e. Santoprene™) or silicone. However, other elastomeric materials are contemplated for use in molding the blades 70, such as, but not limited to, rubber, nitrile rubber, and polyurethane.

A plurality of gaps 76 are formed in each blade 70, and extend from the distal end 74 toward the dowel 48. As illustrated, the gaps 76 extend from the distal end 74 to the base 72, although in another embodiment, the gaps 76 may only extend through a portion of the height of the blade 70. The gaps 76 divide each blade 70 into a plurality of flexible flaps 78 that are arranged in a single row 80 that extends axially along the dowel 48.

The agitating element 20 also comprises an optional secondary portion, having a single elastomeric flap 82 aligned with each blade 70 of the primary portion. As illustrated, the primary and secondary portions are separated by the agitator pulley 47. Due to the placement of the agitator pulley 47, extra flaps 82 may be required to "fill-in" the remaining span of the suction nozzle 18. Like the blades 70, the flaps 82 can be secured to the dowel 48 by various manufacturing techniques, such as overmolding, insert molding, application of an adhesive or mechanical engagement. As illustrated, the flaps 82 are secured to the dowel 48 using overmolding; as such, the flaps 82 are formed from one continuous piece of material connected by a base 84 made of the same material that wraps around the dowel 48.

Both the gaps 76 in the blades 70 and the nominal thickness "T" of the blades 70 can be relatively small as compared to a width "W" of the flaps 78 (i.e. as compared with the distance between the adjacent gaps 76). The width of the gaps 76 in the blades 70 can range from 0.5 mm to 2.0 mm, but can also be adjusted to accommodate various configurations. The nominal thickness "T" (FIG. 17) of each blade 70 is 1.0 mm, although a thickness range from approximately 0.75 mm to 2.0 mm is contemplated. The width "W" of each flap 78 ranges from approximately 5 mm to 20 mm, although narrower or wider flaps 78 are contemplated, depending on the length of the dowel 48. Further, as illustrated, the width "W" of the flaps 78 may vary; alternatively, each flap 78 can have the same width "W". The average height "H" of the blades 70 is approximately 10 mm, although different heights "H" are contemplated. In the embodiment shown, the height profile of each blade 70 substantially constant; the height profile appears to taper in FIG. 4 because the blades 70 are helically oriented. Alternatively, the height profile of the blades 70 can vary between ends of the dowel 48. Furthermore, the height profile of successive blades 370 can be different. The blades 70 can also be notched to accommodate features within the nozzle body 10, for example drive belts or other structural features. As illustrated one of the flaps 78 of each blade 70 is provided with a notch 86 for accommodating a rib 87 within the nozzle body 10.

Figure 6:
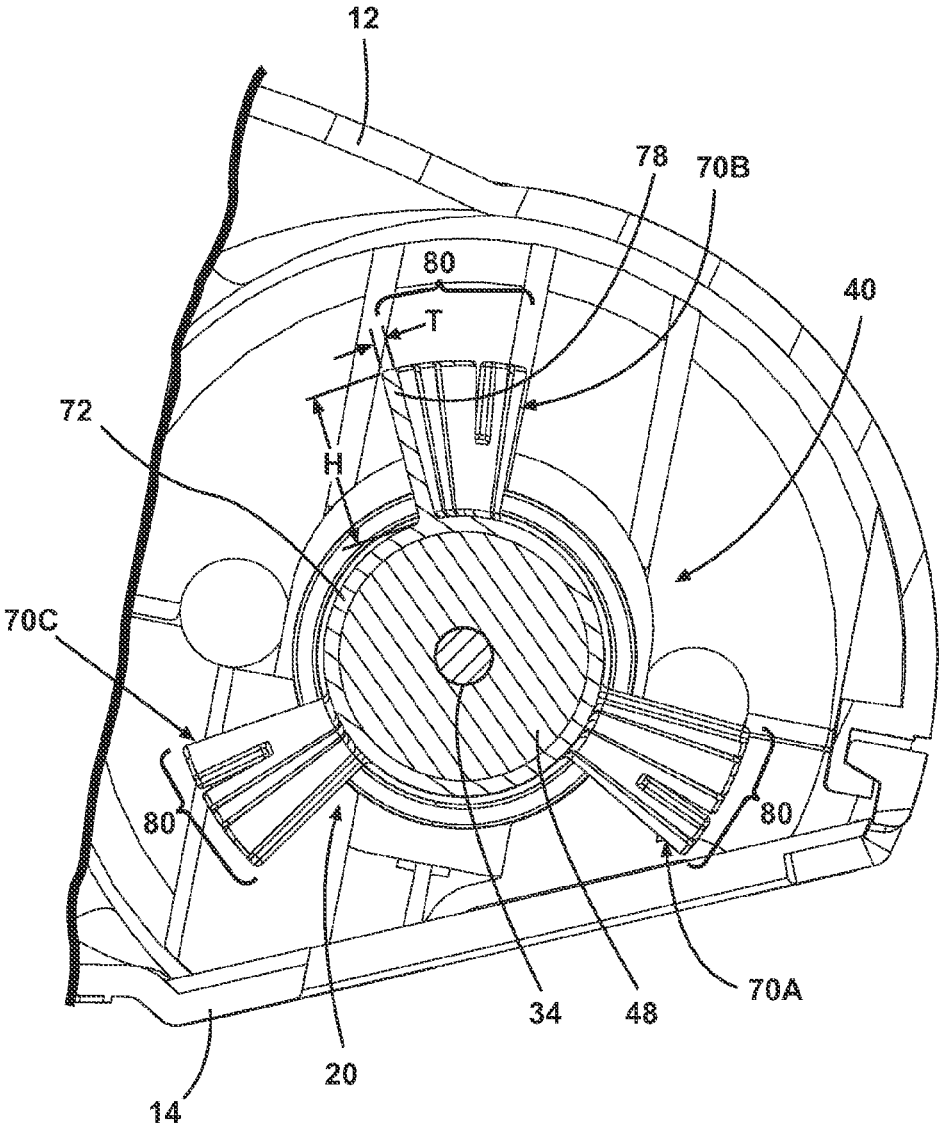
FIG. 6 is a partial cross-sectional view taken along line 6-6 of FIG. 5.
Figure 7:
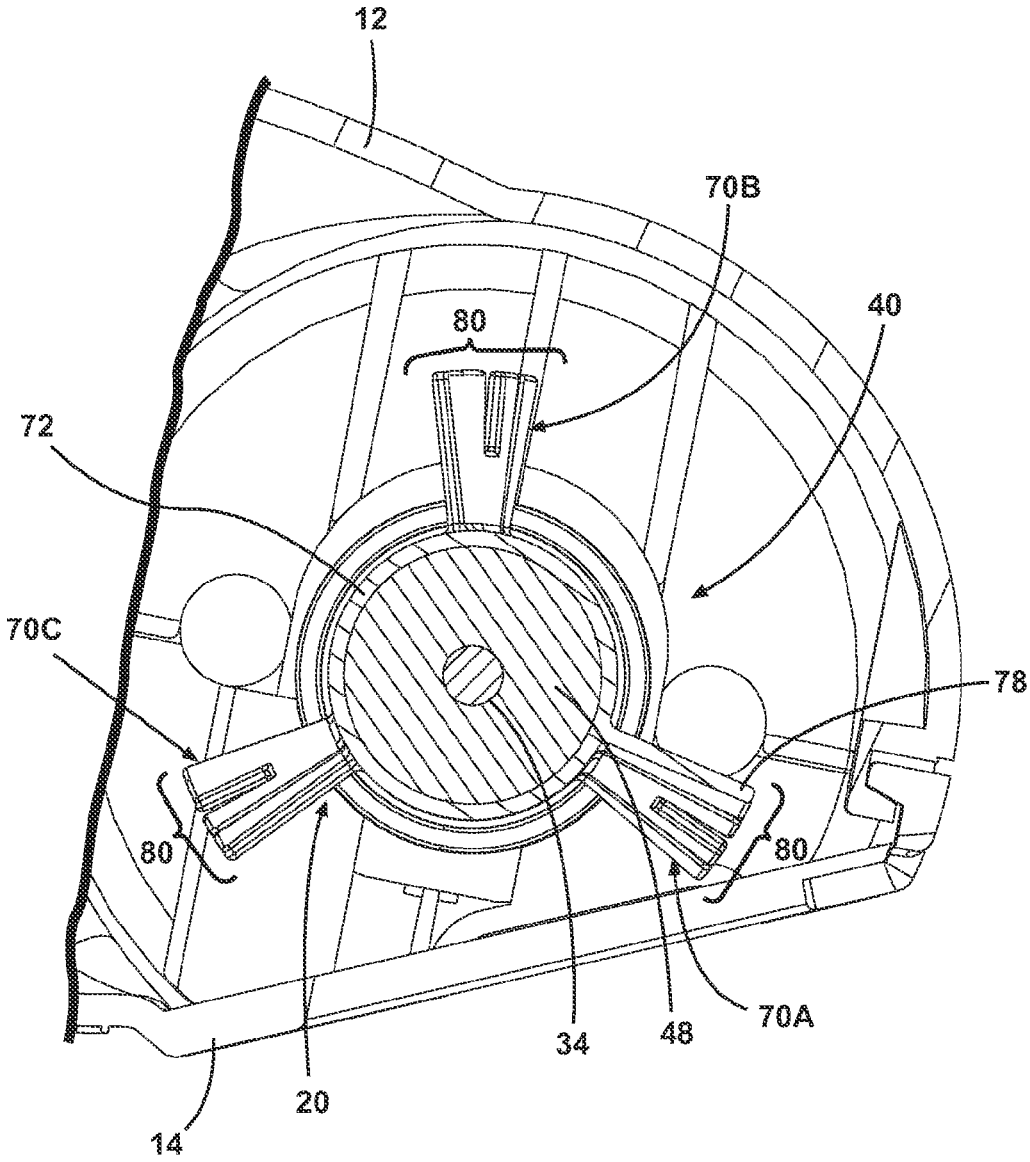
FIG. 7 is a partial cross-sectional view taken along line 7-7 of FIG. 5.
Figure 8:
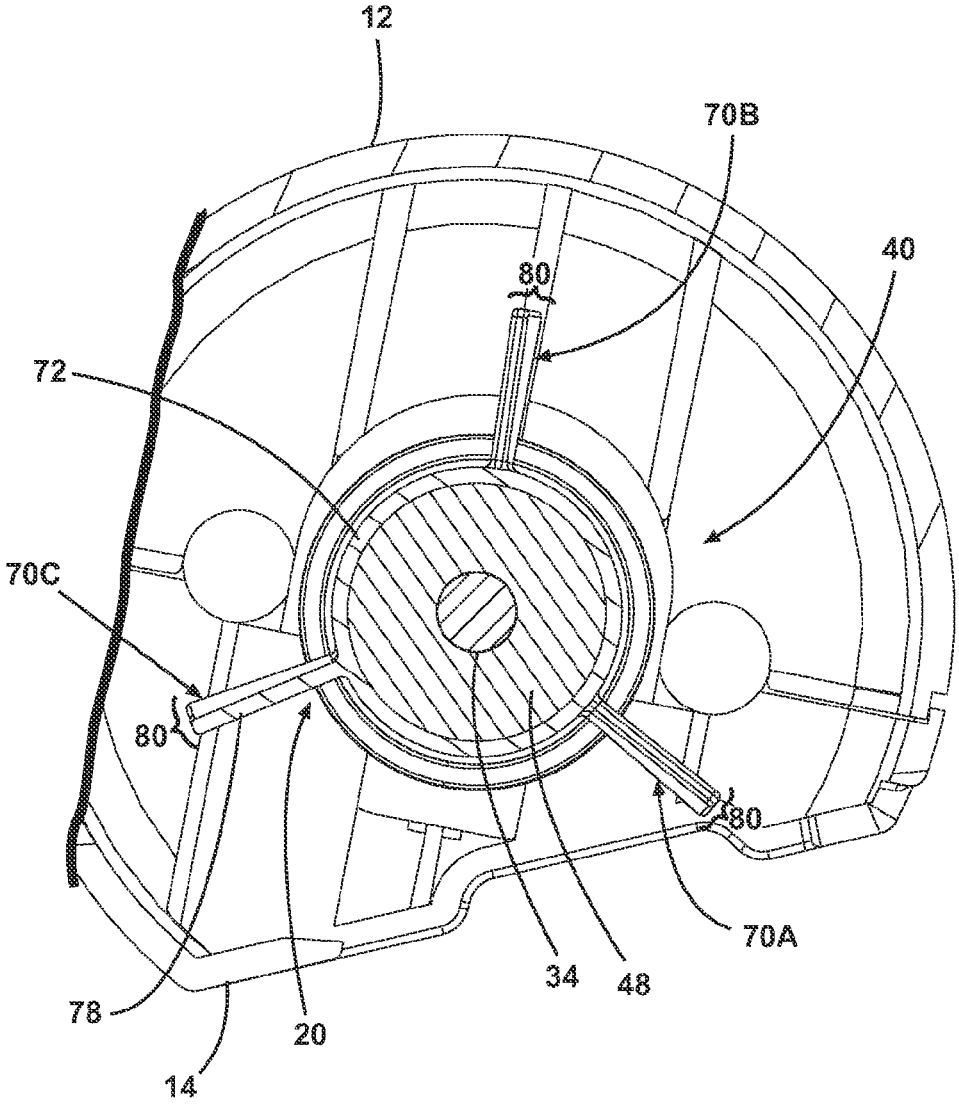
FIG. 8 is a partial cross-sectional view taken along line 8-8 of FIG. 5.

Referring to FIGS. 6-8, the flaps 78 in each blade 70 are at least partially juxtaposed so that at least one of the gaps 76 in the blades 70 do not align with at least one of the gaps 76 in at least one of the other successive blades 70. Referring to FIG. 6, which shows a cross-sectional view taken along line 6-6 of FIG. 5, the section datum intersects one pair of the aligned gaps 76 of blades 70A and 70C, and intersects one of the flaps 78 of blade 70B. FIG. 7 shows a cross-sectional view taken along line 7-7 of FIG. 5. This section datum intersects one of the flaps 78 of blade 70A and one pair of the aligned gaps 76 of blades 70B and 70C. FIG. 8 shows a cross-sectional view taken along line 8-8 of FIG. 5 and intersects one pair of the aligned gaps 76 of blades 70A and 70B and intersects one of the flaps 78 of blade 70C. It can further been seen in FIG. 5 that each blade pair includes two pairs of aligned gaps 76.

Accordingly, the flaps 78 and gaps 76 of each blade 70 are juxtaposed relative to those of other blades 70 such that the gaps 76 in at least one of the blades 70 are misaligned with the gaps 76 in at least one of the successive blades 70 oriented along a co-planar datum perpendicular to the longitudinal axis of the dowel 48. A flap 78 of at least one blade 70 is offset to obstruct aligned gaps 76 in the successive blades 70. Offsetting the gaps 76 has been shown to prevent hair from wrapping around the agitator assembly 40, which is a commonly-encountered problem in the floor care industry. Hair wrap around the agitator assembly 40 can bind up the agitator bearing assemblies 42 and eventually jam the agitator assembly 40, preventing free rotation thereof and inhibiting debris pickup.

In addition to reducing hair wrap, the plurality of flaps 78 exhibit improved flexibility relative to a single continuous blade 70, and thus less force and torque are required to deflect the blades 70 and rotate the agitator assembly 40 during use. Furthermore, each flap 78 can deflect independently of an adjacent flap 78 of the same blade 70 to accommodate contoured or otherwise non-uniform cleaning surfaces. Moving contact between the distal end 74 of the blades 70 and the surface forms an electrostatic charge. Accordingly, a significant electrostatic charge develops on the blade 70, which can thereby attract a large quantity of surface hair and debris, including relatively heavy hair and debris.

In operation, a user fluidly connects the vacuum accessory tool 10 to a downstream suction source via a suction hose (not shown) to draw a working airflow through the suction nozzle 18. A user moves the tool across the surface to be cleaned in a reciprocal motion. The working air flows through the agitator chamber 38, into the impeller chamber 50 and contacts the impeller blades 54, causing the impeller 52 to rotate. The impeller axle 62 rotates within the bearing assemblies 58 and the belt pulley 64 rotates cooperatively with the axle 62. The belt pulley 64 rotates the drive belt 68, which, in turn, engages the agitator pulley 47 and rotates the dowel 48. The agitating element 20 attached to the dowel 48 rotates cooperatively therewith and engages the cleaning surface. The juxtaposed flaps 78 of the blades 70 successively contact the cleaning surface. The blades 70 agitate the surface and facilitate ingestion of dirt, debris, and hair into the suction nozzle 18, thereby entraining it in the working airflow. The gaps 76 formed in the blades 70 permit facile deflection of the flaps 78, thereby reducing the drive torque required to rotate the dowel 48 when the agitating element 20 is in contact with the cleaning surface. The gaps 76 in successive blades 70 are purposefully misaligned to prevent hair from wrapping around the dowel 48 and subsequently jamming agitator bearing assemblies 42 or enshrouding the agitating element 20. Accordingly, at least one flap 78 interrupts successive aligned gaps 76 of successive blades 70. Upon entrainment of debris into the working air path, the debris passes through the agitator chamber 38, into the impeller chamber 50 and around the impeller blades 54 and exits the vacuum accessory tool 10 through the conduit 36, whereupon the working air passes through the suction hose and into a downstream suction source, where debris can be separated from the working air and collected in a dirt cup or filter bag as is commonly known in the art.

Results of a laboratory hair wrap test conducted under controlled laboratory conditions reveals hair wrap performance of various agitator configurations as described hereinafter. Three accessory tools having different agitator assemblies were tested, including: "sample 1" having the aforementioned blade and offset gap configuration shown in the embodiment of FIGS. 1-8; "sample 2" having blades with aligned gaps; and "sample 3", a control sample comprising a conventional brush dowel with a plurality of conventional bristle tufts commonly known in the art. A one gram [1 g] quantity of human hair ranging in length from six (6) to eight (8) inches was introduced to the accessory tool for ingestion through the suction nozzle. Upon ingestion of the hair, each agitator assembly was removed from the agitator chamber and the quantity of hair remaining wrapped around the dowel was weighed. Three (3) trials were performed for each of the three (3) sample agitator assembly configurations. The average results showed that the "sample 2" agitator assembly with blades having aligned gaps retained 20% less hair than the control "sample 3" with conventional bristle-tufted brush dowel. However, the "sample 1" agitator assembly with blades having offset gaps surpassed the performance of "sample 2" and retained 48% less hair than the control "sample 3" comprising the conventional bristle-tufted brush dowel.

| Sample Description | Hair Remaining on Agitator [g] | % Improvement over control Sample 3 |
|---|---|---|
| Sample 1 (blades with offset gaps) | 0.26 g | 48% |
| Sample 2 (blades with aligned gaps) | 0.40 g | 20% |
| Sample 3 (control sample with bristle tufts) | 0.50 g | — |

While the invention has been specifically described in connection with certain specific embodiments thereof, it is to be understood that this is by way of illustration and not of limitation. Reasonable variation and modification are possible within the scope of the foregoing description and drawings without departing from the scope of the invention, which is described in the appended claims.

What is claimed is:

1. A vacuum accessory tool comprising:

a nozzle body;

a suction nozzle formed by the nozzle body;

a suction conduit formed in the nozzle body and adapted to be connected to a suction source remote from the nozzle body for generating a working air flow from the suction nozzle through the nozzle body; and an agitator assembly mounted to the nozzle body and positioned adjacent the suction nozzle and comprising;

a dowel mounted within the nozzle body for rotational movement about an axis; and an agitating element provided on the dowel and comprising a plurality of resilient blades extending generally axially along and projecting outwardly from the dowel;

wherein at least two of the resilient blades have a gap therein extending from a distal end of the blade toward the dowel, and wherein the gap in one of the at least two resilient blades is axially offset from the gap in another of the at least two resilient blades; and wherein the at least two resilient blades comprise a plurality of gaps and the gaps formed in at least one of the at least two resilient blades are relatively small in comparison to the distance between the gaps formed in the at least one of the at least two resilient blades.

2. The vacuum accessory tool from claim 1 wherein the thickness of the blades is relatively small in comparison to the distance between the gaps formed in at least one of the at least two resilient blades.

3. The vacuum accessory tool from claim 1 wherein each of the plurality of resilient blades comprise a single row of flaps, wherein adjacent flaps are separated by a gap.

4. The vacuum accessory tool from claim 1 wherein the at least two resilient blades comprises three resilient blades that are radially spaced from one another.

5. The vacuum accessory tool from claim 4 wherein the gap in one of the resilient blades is axially offset from the gap in another of the resilient blades and is axially aligned with the gap in another of the resilient blades.

6. The vacuum accessory tool from claim 4 and further comprising a plurality of gaps formed in each of the three resilient blades.

7. The vacuum accessory tool from claim 1 wherein the plurality of resilient blades are made from an elastomeric material.

8. The vacuum accessory tool from claim 7 wherein the elastomeric material is selected from the group consisting of at least one of EPDM (ethylene propylene diene monomer) rubber, polypropylene, nitrile rubber, and polyurethane.

9. The vacuum accessory tool from claim 7 wherein the plurality of resilient blades are integrally molded in one piece out of the elastomeric material.

10. The vacuum accessory tool from claim 1 wherein the plurality of resilient blades extend along the dowel in a non-parallel orientation with respect to the axis.

11. The vacuum accessory tool from claim 10 wherein the plurality of resilient blades are helical.

12. The vacuum accessory tool from claim 1 further comprising an air-driven impeller assembly in fluid communication with the suction nozzle and the suction source for driving the impeller assembly, and operably coupled with the agitator assembly for rotating the agitator assembly about the axis.

13. The vacuum accessory tool from claim 1 further comprising a motor operably interconnected with the dowel for imparting rotational movement thereto.

14. The vacuum accessory tool from claim 1 further comprising a belt drive assembly operably interconnected to the dowel for imparting rotational movement thereto.

15. A vacuum accessory tool comprising:

a nozzle body;

a suction nozzle formed by the nozzle body;

a suction conduit formed in the nozzle body and adapted to be connected to a suction source remote from the nozzle body for generating a working air flow from the suction nozzle through the nozzle body; and an agitator assembly mounted to the nozzle body and positioned adjacent the suction nozzle and comprising;

a dowel mounted within the nozzle body for rotational movement about an axis; and an agitating element provided on the dowel and comprising a plurality of resilient blades extending generally axially along and projecting outwardly from the dowel;

wherein at least two of the resilient blades have a gap therein extending from a distal end of the blade toward the dowel, and wherein the gap in one of the at least two resilient blades is axially offset from the gap in another of the at least two resilient blades; and wherein the at least two resilient blades comprise a plurality of gaps and the distance between the gaps formed in at least one of the at least two resilient blades varies.

16. The vacuum accessory tool from claim 15 wherein at least one gaps in the one of the at least two resilient blades is axially aligned with at least one gap in the another of the at least two resilient blades.

* * * * *